US009403663B2

(12) United States Patent
Dellarippa et al.

(10) Patent No.: US 9,403,663 B2
(45) Date of Patent: Aug. 2, 2016

(54) MANAGING REMOTE CONTROL OF AN ELEVATOR SYSTEM

(75) Inventors: Henry Dellarippa, South Windsor, CT (US); Karl D. Pedersen, Terryville, CT (US); Craig Drew Bogli, Avon, CT (US); Medha Ramakant Dedgaonkar, Maharashtra (IN); Jean Manuel Sanches, Domont (FR)

(73) Assignee: Otis Elevator Company, Farmington, CT (US)

( * ) Notice: Subject to any disclaimer, the term of this patent is extended or adjusted under 35 U.S.C. 154(b) by 473 days.

(21) Appl. No.: 14/114,536

(22) PCT Filed: May 10, 2011

(86) PCT No.: PCT/US2011/035846

§ 371 (c)(1),
(2), (4) Date: Oct. 29, 2013

(87) PCT Pub. No.: WO2012/154170

PCT Pub. Date: Nov. 15, 2012

(65) Prior Publication Data

US 2014/0069745 A1 Mar. 13, 2014

(51) Int. Cl.
*B66B 1/34* (2006.01)
*B66B 5/00* (2006.01)

(52) U.S. Cl.
CPC . *B66B 5/005* (2013.01); *B66B 1/34* (2013.01); *B66B 1/3461* (2013.01); *B66B 5/0087* (2013.01)

(58) Field of Classification Search
CPC ..... B66B 5/005; B66B 1/34; B66B 1/3461; B66B 5/0087
USPC ..... 187/247, 277, 380–388, 391–393
See application file for complete search history.

(56) References Cited

U.S. PATENT DOCUMENTS

| | | | | |
|---|---|---|---|---|
| 4,330,838 | A * | 5/1982 | Yoneda | B66B 5/0087 187/393 |
| 4,568,909 | A | 2/1986 | Whynacht | |
| 4,697,243 | A * | 9/1987 | Moore | B66B 5/0087 178/4.1 B |
| 5,445,245 | A | 8/1995 | Ketoviita | |
| 5,817,994 | A | 10/1998 | Fried et al. | |
| 6,202,797 | B1 * | 3/2001 | Skolnick | A41D 13/00 187/279 |
| 6,330,935 | B1 * | 12/2001 | Systermans | B66B 5/0025 187/391 |
| 7,073,633 | B2 * | 7/2006 | Weinberger | B66B 5/0025 187/247 |
| 7,172,055 | B2 * | 2/2007 | Engel | B66B 25/006 187/391 |

(Continued)

FOREIGN PATENT DOCUMENTS

| | | | |
|---|---|---|---|
| JP | 2001026382 | A | 1/2001 |
| JP | 2002003114 | A | 1/2002 |

(Continued)

OTHER PUBLICATIONS

Extended European Search Report for Application No. EP 11 86 5039 dated Sep. 11, 2014.

(Continued)

*Primary Examiner* — Anthony Salata
(74) *Attorney, Agent, or Firm* — Carlson, Gaskey & Olds

(57) ABSTRACT

An exemplary method of managing remote control of an elevator system includes preventing any source located remotely from a site of the elevator system from controlling an operation of the elevator system when there is an indication that the elevator system is being serviced by a mechanic.

17 Claims, 1 Drawing Sheet

(56) References Cited

U.S. PATENT DOCUMENTS

| | | | | |
|---|---|---|---|---|
| 7,523,809 | B2 | 4/2009 | Monzon-Simon et al. | |
| 7,954,606 | B2 * | 6/2011 | Tinone | B66B 5/005 187/384 |
| 2008/0236956 | A1 | 10/2008 | Finschi | |
| 2008/0283342 | A1 | 11/2008 | Deplanzes et al. | |
| 2009/0218178 | A1 | 9/2009 | Lence-Barreiro | |
| 2011/0083926 | A1 * | 4/2011 | Rasanes | B66B 5/0087 187/300 |
| 2011/0155510 | A1 * | 6/2011 | Lindberg | B66B 13/22 187/314 |
| 2012/0018256 | A1 * | 1/2012 | Mangini | B66B 5/0043 187/247 |
| 2014/0262629 | A1 * | 9/2014 | Toutaoui | B66B 1/3461 187/393 |
| 2015/0251875 | A1 * | 9/2015 | Lustenberger | B66B 5/0031 700/275 |

FOREIGN PATENT DOCUMENTS

| | | | |
|---|---|---|---|
| JP | 2003095553 | A | 4/2003 |
| JP | 2003176085 | A | 6/2003 |
| JP | 2003306277 | A | 10/2003 |
| JP | 2007091381 | A | 4/2007 |
| JP | 2007290831 | A | 11/2007 |
| JP | 2009286503 | A | 12/2009 |
| KR | 10-1999-0074721 | A | 10/1999 |

OTHER PUBLICATIONS

International Preliminary Report on Patentability for International application No. PCT/US2011/035846 dated Nov. 21, 2013.

International Search Report and Written Opinion of the International Searching Authority for International Application No. PCT/US2011/035846 dated Feb. 9, 2012.

* cited by examiner

MANAGING REMOTE CONTROL OF AN ELEVATOR SYSTEM

BACKGROUND

Elevator systems often include a remote elevator monitoring device that communicates with other devices that are located at sites that are remote from the site of the elevator system, for example. Remote elevator monitoring devices provide information regarding elevator system operation or conditions to remotely located monitoring centers, for example. Remote elevator monitoring devices also often allow remotely located devices to provide command or control signals to the elevator system for purposes of controlling an operation of the elevator system.

SUMMARY

An exemplary method of managing remote control of an elevator system includes preventing any source located remotely from a site of the elevator system from controlling an operation of the elevator system when there is an indication that the elevator system is being serviced by a mechanic.

An exemplary elevator system includes a remote elevator monitoring device that is configured to prevent any source located remotely from a site of the elevator system from controlling an operation of the elevator system when there is an indication that the elevator system is being serviced by a mechanic.

The various features and advantages of a disclosed example will become apparent to those skilled in the art from the following detailed description. The drawings that accompany the detailed description can be briefly described as follows.

DETAILED DESCRIPTION

Figure 1:
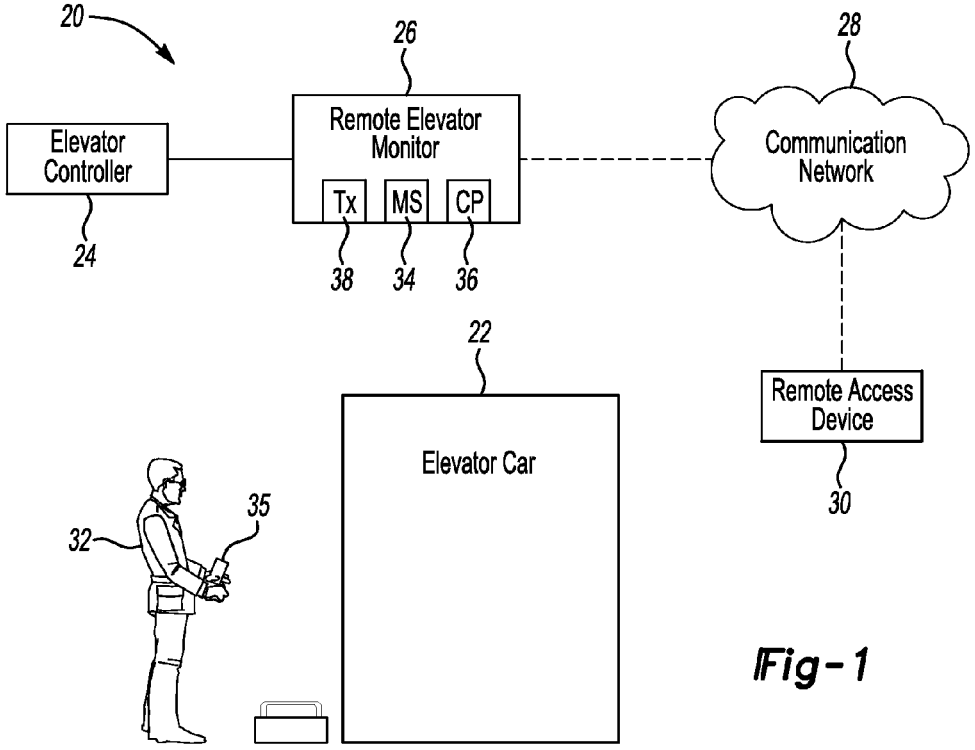
FIG. 1 schematically illustrates selected portions of an elevator system designed according to an embodiment of this invention.

FIG. 1 schematically shows selected portions of an elevator system 20. An elevator car 22 is situated for providing elevator service in a known manner. An elevator controller 24 controls movement of the elevator car 22.

A remote elevator monitoring device 26 allows for communications over a communication network 28 between the elevator system 20 and remotely located devices such as the example remote access device 30. The remote elevator monitoring device 26 provides information to such remotely located devices regarding various operating parameters or conditions of the elevator system 20. Such remote elevator monitoring devices are known in the industry.

The example remote elevator monitoring device 26 is unique in that it controls whether the remote access device 30 is capable of communicating with the elevator system 20 to control an operation of the elevator system 20. For example, the remote elevator monitoring device 26 selectively prevents any remote access device 30 from communicating a command to the elevator controller 24 to cause movement of the elevator car 22. The remote elevator monitoring device 26 prevents such communication whenever there is an indication that an elevator mechanic 32 is servicing the elevator system 20. It is desirable to limit any remote control over operation of the elevator system 20 when the mechanic 32 is conducting a service operation.

The example of FIG. 1 includes a manual switch (MS) 34 associated with the remote elevator monitoring device 26. The mechanic 32 manually actuates the switch 34 when the mechanic 32 is at the site of the elevator system 20 and intends to begin servicing the elevator system 20. The remote elevator monitoring device 26 determines a condition of the switch 34, which is associated with the remote elevator monitoring device 26. In this example the switch 34 is at the same position as the remote elevator monitoring device 26. When the switch 34 has been manually manipulated by the mechanic 32 into a position to provide an indication that a service operation is ongoing, the remote elevator monitoring device 26 determines that the elevator system 20 is being serviced by the mechanic 32. In other words, the switch 34 is manually actuated by the mechanic 32 to provide an indication that there is an ongoing service procedure.

The example of FIG. 1 also includes the ability to determine that a mechanic is serving the elevator system by detecting when the mechanic 32 has used a service tool 35 in a manner that is consistent with how the service tool 35 would be used during elevator service. In this example, a communication port (CP) 36 is configured to be connected with the servicing tool 35. In other words, the mechanic 32 may manually plug in a connector between the servicing tool 35 and the communication port 36 to allow the mechanic to conduct various service operations. In this example, the remote elevator monitoring device 26 detects whenever there is a connection with a communication port 36 and uses that as an indication that a service procedure has begun. In one such example, even if the switch 34 has not been manually actuated, detecting a connection with the communication port 36 allows the remote elevator monitoring device 26 to determine that a service procedure is ongoing.

The example of FIG. 1 also allows for the servicing tool 35 to be a communication device that wirelessly communicates with a transceiver 38 that is configured to receive such wireless communication signals. In this example, the transceiver 38 is associated with the remote elevator monitoring device 26 in a manner that allows it to use reception of a signal by the transceiver 38 as an indication that a mechanic is servicing the elevator system 20.

Some examples will include only the manual switch 34 for providing an indication that a mechanic is servicing the elevator system. Other examples will include only the transceiver 38 or the communication port 36 for providing the indication that the elevator system is being serviced. Still other examples will include a combination of two or more of the manual switch 34, the communication port 36 and the transceiver 38 to allow the remote elevator monitoring device 26 to determine when a mechanic is servicing the elevator system.

Figure 2:
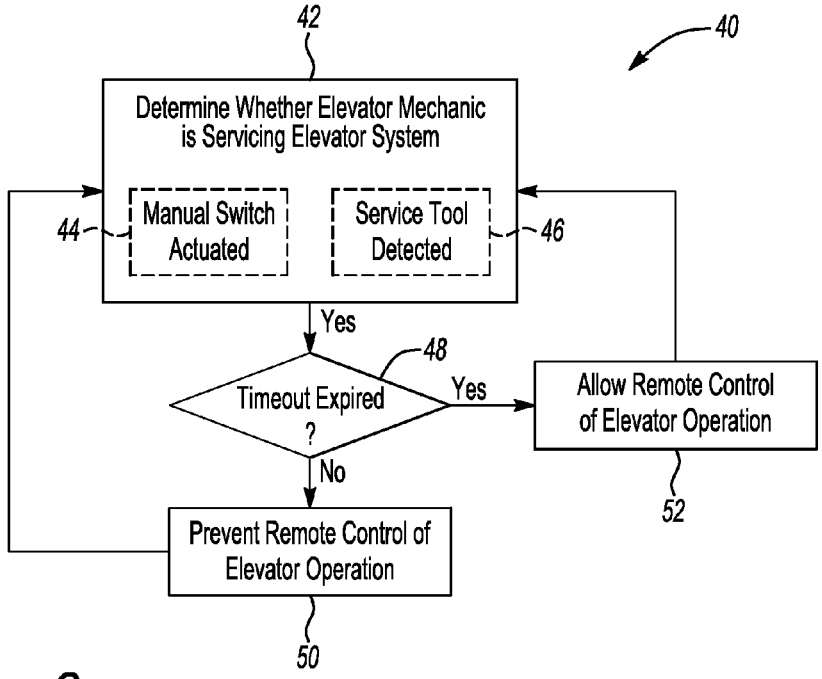
FIG. 2 is a flowchart diagram summarizing an example approach designed according to an embodiment of this invention.

FIG. 2 includes a flow chart diagram 40 that summarizes an example approach to managing remote control over an elevator system. At 42, a determination is made whether an elevator mechanic is servicing the elevator system. This determination is made by the remote elevator monitoring device 26, for example. In FIG. 2, there is the possibility of making the determination that a mechanic is serving the elevator system by detecting whether a manual switch is actuated at 44. Additionally, it is possible to detect the presence of a service tool at 46 by detecting wireless communications from such a service tool or detecting that such a service tool has been connected with a communication port of the elevator system, for example.

If there is an indication that an elevator mechanic is servicing the elevator system, a determination is made at 48 whether a preselected time period has expired. In this example, the remote elevator monitoring device 26 initiates a time period responsive to receiving an indication that the mechanic 32 intends to begin servicing the elevator system. In one example, the preselected time period is equivalent to a normal work day and is on the order of eight or nine hours. This feature allows for addressing a situation in which a mechanic 32 manually actuates the switch 34, for example, at the beginning of a service procedure and then leaves the site of the elevator system without resetting the switch 34 to indicate that the service procedure has been completed.

If there is an indication that the elevator system is in service and the preselected time period has not yet expired, then the remote elevator monitoring device 26 prevents remote control of elevator operation at 50. In some examples, the indication will interrupt any ongoing remote control that may have started before a mechanic initiates a service procedure. In other words, the decision to prevent remote control of elevator operation can be made anytime that a mechanic initiates or is continuing with a service procedure regardless of the current status of the elevator system. In one example, the remote elevator monitoring device 26 filters out any command signals from a remote access device 30 that are received over the communication network 28 so that any such command signals will not have any affect on the operation of the elevator system.

In FIG. 2, if the time period has expired at 48 then remote control of elevator operation is allowable at 52. This feature allows for restoring normal remote communications through the remote elevator monitoring device 26 after a sufficient time period during which an elevator mechanic would have completed servicing the elevator system or will have at least temporarily suspended the service procedure to return to work the next day. Of course, if the elevator mechanic returns the next day, the remote elevator monitoring device 26 will receive another indication from the mechanic that a service procedure is intended. At that point, the remote elevator monitoring device 26 will reset the timer for the preselected time period and prevent remote elevator system control for at least that time period unless the mechanic provides an indication that the service procedure has been completed prior to expiration of that time period.

In one example, the step shown at 52 includes limiting the number of remote control sources at a given time. For example, if one authorized source of remote control commands (e.g., the remote access device 30) is controlling the elevator operation, the ability for another remote control device to control the elevator system is limited or prevented entirely. In some examples only one remote access device can be used at a time. In another example, only one remote access device issues commands but another can be used to monitor elevator system performance at that same time.

The example remote elevator monitoring device 26 maintains status information regarding the elevator system for controlling whether a remote access device is allowed to control an operation of the elevator system. Whenever the remote elevator monitoring device 26 determines that the elevator system is being serviced by a mechanic, the remote elevator monitoring device 26 prevents remote control over the elevator system.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of managing remote control of an elevator system, comprising:

preventing any source located remotely from a site of the elevator system from controlling an operation of the elevator system when there is an indication that the elevator system is being serviced by a mechanic;

determining whether a preselected time period has expired since the indication was provided;

performing the preventing when the indication exists and the time period has not yet expired; and overriding the preventing when the time period has expired even if the indication still exists.

2. The method of claim 1, comprising determining whether a switch has been manually actuated by a mechanic, the switch providing the indication that the elevator system is being serviced by the mechanic.

3. The method of claim 1, comprising determining whether a mechanic servicing tool has been connected with a portion of the elevator system, the servicing tool having been connected providing the indication that the elevator system is being serviced by the mechanic.

4. The method of claim 3, wherein the portion of the elevator system comprises a port adapted to be connected with the servicing tool.

5. The method of claim 4, wherein the portion of the elevator system comprises a remote elevator monitoring device that includes the port.

6. The method of claim 1, comprising determining whether a mechanic has used a communication device to wirelessly communicate with a portion of the elevator system.

7. The method of claim 6, wherein the portion of the elevator system comprises a transceiver adapted to communicate with the communication device configured to allow a mechanic to service the elevator system.

8. The method of claim 7, wherein the portion of the elevator system comprises a remote elevator monitoring device that includes the transceiver.

9. The method of claim 1, comprising initiating the time period responsive to at least one of (i) a mechanic manually actuating a switch that provides the indication, (ii) a mechanic connecting a servicing tool with a portion of the elevator system, or (iii) a mechanic using a communication device to wireless communicate with a portion of the elevator system.

10. An elevator system, comprising:

a remote elevator monitoring device that is configured to prevent any source located remotely from a site of the elevator system from controlling an operation of the elevator system when there is an indication that the elevator system is being serviced by a mechanic, initiate a preselected time period responsive to a beginning of the indication, prevent a source located remotely from the site of the elevator system from controlling an operation of the elevator system when the indication exists and the time period has not yet expired, and override the indication to allow a source located remotely from the elevator system to control an operation of the elevator system when the time period has expired even if the indication still exists.

11. The system of claim 10, comprising a switch configured to be manually actuated by a mechanic, the switch providing the indication that the elevator system is being serviced by the mechanic.

12. The system of claim 11, wherein the switch is associated with the remote elevator monitoring device.

13. The system of claim 10, comprising a port on a portion of the elevator system that is configured to be connected with a servicing tool, and wherein a mechanic connecting the servicing with the port provides the indication that the elevator system is being serviced by the mechanic.

14. The system of claim 13, wherein the elevator monitoring device includes the port.

15. The system of claim 10, comprising a transceiver adapted to communicate with a communication device configured to allow a mechanic to service the elevator system, and wherein the transceiver provides the indication responsive to receiving a wirelessly transmitted communication from the communication device.

16. The system of claim 15, wherein the remote elevator monitoring device includes the transceiver.

17. The system of claim 10, wherein the remote elevator monitoring device is configured to automatically begin the time period responsive to at least one of (i) a mechanic manually actuating a switch that provides the indication, (ii) a mechanic connecting a servicing tool with a portion of the elevator system, or (iii) a mechanic using a communication device to wireless communicate with a portion of the elevator system.

* * * * *